US009784042B2

(12) United States Patent
Whitefield et al.

(10) Patent No.: US 9,784,042 B2
(45) Date of Patent: Oct. 10, 2017

(54) RISER CLAMP ASSEMBLY

(71) Applicants: William H. Whitefield, Houston, TX (US); Brandon Carringer, Houston, TX (US)

(72) Inventors: William H. Whitefield, Houston, TX (US); Brandon Carringer, Houston, TX (US)

(73) Assignee: Whitefield Plastics Corp., Houston, TX (US)

( * ) Notice: Subject to any disclaimer, the term of this patent is extended or adjusted under 35 U.S.C. 154(b) by 0 days.

(21) Appl. No.: 14/625,362

(22) Filed: Feb. 18, 2015

(65) Prior Publication Data

US 2016/0237758 A1 Aug. 18, 2016

(51) Int. Cl.

| | |
|---|---|
| ***E21B 17/02*** | (2006.01) |
| ***E21B 17/01*** | (2006.01) |
| ***E21B 17/10*** | (2006.01) |

(52) U.S. Cl.

CPC ..... *E21B 17/01* (2013.01); *E21B 17/1035* (2013.01)

(58) Field of Classification Search

CPC ..... E21B 17/02; E21B 17/01; E21B 17/023
USPC ..... 166/360
See application file for complete search history.

(56) References Cited

U.S. PATENT DOCUMENTS 6,976,695 B1 * 12/2005 Smith, III ..... B60D 1/28 280/507
2011/0042095 A1 * 2/2011 Sessions ..... E21B 17/085 166/360

* cited by examiner

*Primary Examiner* — Matthew R Buck
*Assistant Examiner* — Patrick Lambe
(74) *Attorney, Agent, or Firm* — Conley Rose, P.C.

(57) ABSTRACT

A clamp assembly for coupling an auxiliary line to a marine riser includes a clamp body having a central axis and an interface radially spaced from the central axis and a clamp cap having an interface configured to be inserted axially into the interface of the clamp body, wherein the clamp body is configured to clamp to the marine riser, and the clamp body and clamp cap are configured to retain the auxiliary line in an aperture formed between the interface of the clamp body and the interface of the clamp cap.

20 Claims, 10 Drawing Sheets

RISER CLAMP ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

The disclosure relates generally to equipment used in offshore oil and gas drilling, production, and other associated operations. More particularly, the disclosure relates to clamp assemblies for securing auxiliary lines to marine risers used in oil and gas drilling, production, and other associated operations.

In some offshore oil and gas drilling and production operations, a marine riser extends between a drilling and/or production rig at the water line and a subsea structure, for instance, a blowout preventer (BOP) coupled to a wellhead disposed on a sea floor underneath the rig. Disposed within the marine riser may be a drill string extending through the wellhead into a borehole drilled into a subterranean formation below the sea floor. Drilling fluids may be pumped through the drill string to a drill bit disposed at the end of the string, and this fluid, along with material cut from the subterranean formation, may be recirculated to the rig via an annulus disposed between the inner surface of the annular marine riser and the outer surface of the drill string. Similarly, following drilling, a marine riser may be used to convey fluids from the subterranean formation to the rig. Thus, the marine riser must be of a relatively large diameter so as to provide multiple independent channels for the communication of fluid between the formation and the rig. Further, the marine riser may also extend thousands of feet between the sea floor and the rig in deepwater operations. In order to prevent buckling of the riser due to its relatively high weight caused by its large diameter and length and the high specific gravity of its associated components (with respect to water), low density foam is coupled to the outer surface of the riser to provide a sufficient buoyancy force to place the riser into tension.

Along with the marine riser, a plurality of auxiliary lines may also extend between the rig and a subsea structure for the transportation of fluids from the surface to the sea floor and/or borehole. These auxiliary lines extend parallel with and proximal to the marine riser, and may also be attached to the buoyancy providing foam. In order to restrict the movement of the auxiliary lines as they react to applied forces during operation, a plurality of riser clamps may be coupled at axially spaced apart locations along the length of the marine riser. Each riser clamp may couple to and be disposed about the marine riser while also being coupled to the auxiliary lines spaced circumferentially about the marine riser. In this way, the movement of the auxiliary lines is restricted and loads applied to the auxiliary lines may be transferred to the relatively more robust marine riser. However, the riser clamps provide additional weight that must be accounted for with additional low density foam to provide sufficient buoyancy. Further, any metal parts of the riser clamps may be exposed to the water, allowing for possible corrosion and failure.

Accordingly, there remains a need in the art for apparatuses and methods for providing marine riser clamps for securing auxiliary lines in offshore oil and gas drilling, production and associated operations. Such apparatuses and methods would be particularly well received if they reduced the weight of the riser clamp and used materials that inhibited corrosion while also providing satisfactory reliability and clamping strength.

SUMMARY

A clamp assembly for coupling an auxiliary line to a marine riser includes a clamp body having a central axis and an interface radially spaced from the central axis and a clamp cap having an interface configured to be inserted axially into the interface of the clamp body, wherein the clamp body is configured to clamp to the marine riser and wherein the clamp body and clamp cap are configured to retain the auxiliary line in an aperture formed between the interface of the clamp body and the interface of the clamp cap. In some embodiments, the clamp assembly also includes a clamp strap configured to couple the clamp body to the marine riser. In some embodiments, the clamp body comprises a nonmetallic material. In certain embodiments, the clamp cap comprises a nonmetallic material. In certain embodiments, the clamp assembly also includes a clamp clip configured to secure the clamp cap to the clamp body. In some embodiments, the clamp clip comprises a nonmetallic material. In some embodiments, a load applied to the clamp cap is transferred from the clamp cap to the clamp body through physical contact between the clamp cap and the clamp body. In certain embodiments, the load is transferred from the clamp body to the marine riser through physical contact between the clamp body and a clamp strap coupled to the clamp body. In certain embodiments, the clamp cap interface comprises a cylindrical tab and the clamp body interface comprises a socket, and wherein the cylindrical tab is configured to be inserted axially into the socket to form the aperture. In some embodiments, the clamp assembly also includes a clamp clip configured to secure the clamp cap to the clamp body, wherein the clamp clip comprises a cylindrical body having an axially extending central bore, and wherein the tab of the clamp cap is configured to be inserted into the bore of the clamp clip to retain the clamp cap to the clamp body. In some embodiments, the interface of the clamp body and the interface of the clamp cap do not comprise metallic components.

A clamp assembly for coupling an auxiliary line to a marine riser includes a nonmetallic clamp body having a central axis and an interface radially spaced from the central axis, and wherein the clamp body comprises a first arcuate section and a second arcuate section, a nonmetallic clamp cap having an interface configured to be coupled to the interface of the clamp body and a clamp strap configured to couple the first arcuate section of the clamp body to the second arcuate section of the clamp body and provide a clamping force to the marine riser, wherein the clamp body and clamp cap are configured to retain the auxiliary line in an aperture formed between the interface of the clamp body and the interface of the clamp cap. In some embodiments, the interface of the clamp cap is configured to be inserted axially into the interface of the clamp body. In some embodiments, the clamp assembly also includes a clamp clip configured to secure the clamp cap to the clamp body. In some embodiments, a load applied to the clamp cap is transferred from the clamp cap to the clamp body through physical contact between the clamp cap and the clamp body.

In certain embodiments, the load is transferred from the clamp body to the marine riser through physical contact between the clamp body and the clamp strap. In certain embodiments, the clamp cap interface comprises a cylindrical tab and the clamp body interface comprises a socket, and wherein the cylindrical tab is configured to be inserted axially into the socket to form the aperture. In some embodiments, the clamp assembly also includes a clamp clip configured to secure the clamp cap to the clamp body, wherein the clamp clip comprises a cylindrical body having an axially extending central bore, and wherein the tab of the clamp cap is configured to be inserted into the bore of the clamp clip to retain the clamp cap to the clamp body.

A method for clamping an auxiliary line to a marine riser includes strapping a first arcuate section of a clamp body to a second arcuate section of a clamp body to provide a clamping force to the marine riser, disposing the auxiliary line adjacent an interface of the clamp body, and inserting the interface of a clamp cap axially with respect to a central axis of the marine riser into the interface of the clamp body to couple the auxiliary line to the clamp body. In some embodiments, the method also includes retaining the clamp cap to the clamp body by coupling a clamp clip to the clamp cap. In some embodiments, the method also includes transferring a load applied to the clamp cap to the marine riser through physical engagement between the clamp cap and clamp body.

It is to be understood that both the foregoing general description and the following detailed description are exemplary of the disclosure and are intended to provide an overview or framework for understanding the nature and character of the apparatuses and methods that are disclosed and claimed. The accompanying drawings are included to provide a further understanding of the disclosure and are incorporated in and constitute a part of this specification. The drawings illustrate various exemplary embodiments of the disclosure and together with the written description serve to explain certain principles and operation of the disclosed embodiments.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
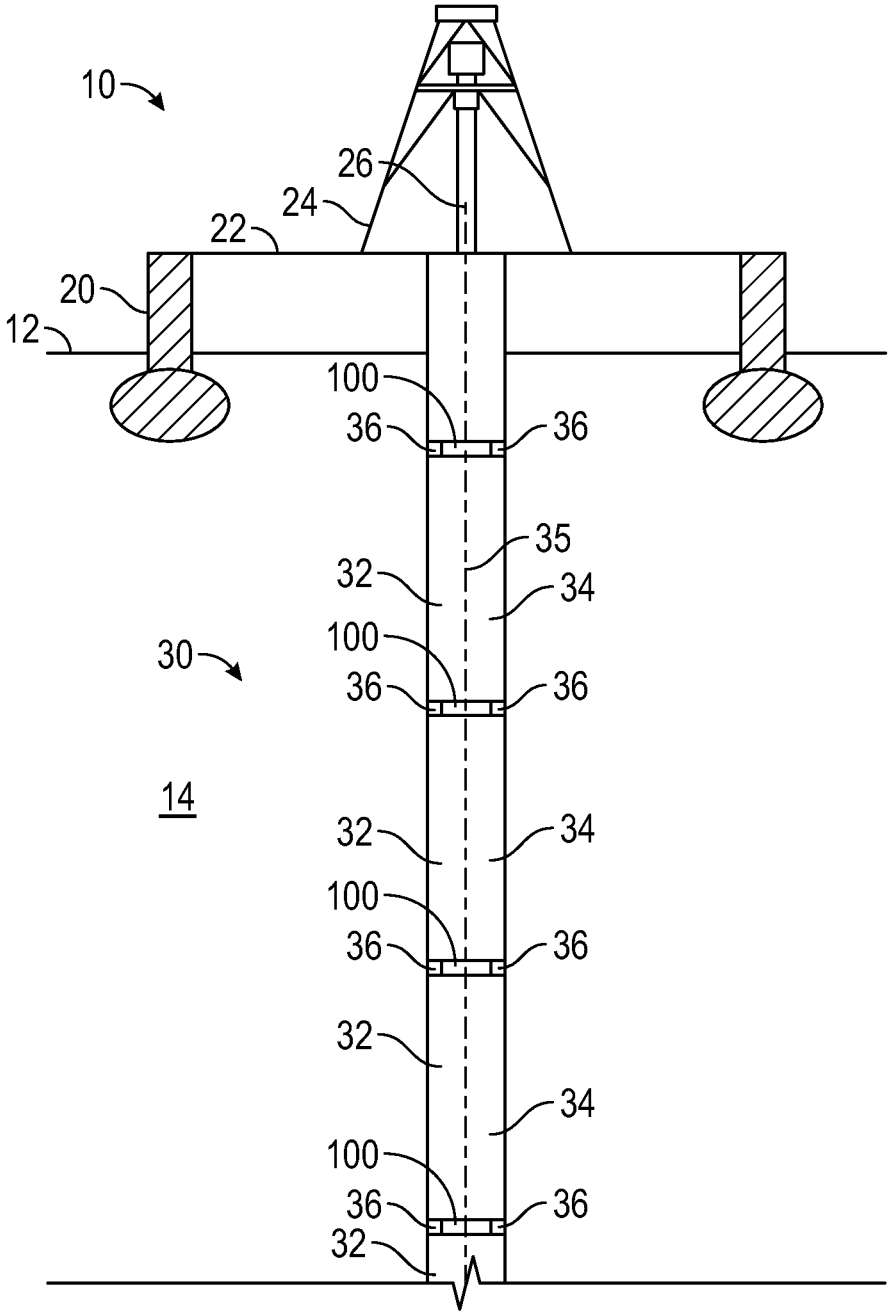
FIG. 1 is a schematic view of an offshore oil and gas drilling and production system in accordance with principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

A riser clamp assembly and method are proposed for providing a riser clamp comprising low density components having a specific gravity similar to water and also having an extended environmental service life in common environmental conditions while providing adequate strength and durability. The proposed riser clamp assembly and method also increase the ease and safety of installing the riser clamp system in an offshore oil and gas drilling and production system by providing a riser clamp having relatively few components, with each assembly having a relatively low mass compared to steel. Embodiments of the riser clamp assembly generally include a clamp body, a plurality of clamp caps that are coupled to the clamp body via a plurality of clamp clips, and a clamp strap disposed about the clamp body. The clamp body, clamp cap, and clamp clips are formed from nonmetallic materials having a specific gravity similar to water and also having an extended environmental service life in common environmental conditions. The clamp body comprises a plurality of arcuate sections that are configured to be disposed about and engage the body of a marine riser, such as the kind used in offshore oil and gas drilling and production operations. The clamp body is configured to be secured to the marine riser by securing the clamp strap about an outer surface of the clamp body. The clamp clips are configured to be inserted parallel to the axis of the marine riser into a corresponding sockets circumferentially spaced about the clamp body, forming an aperture for the placement of an auxiliary line. The clamp clips are configured to be inserted perpendicular of the axis of the marine riser onto legs of the clamp caps, fixing the clamp caps into position on the clamp body. In this way, the riser clamp assembly is configured to secure or clamp the auxiliary lines to the marine riser without using metallic fasteners and by reducing the overall number of components included in the clamp assembly.

Referring to FIG. 1, an embodiment of an offshore oil and gas drilling and production system 10 is shown. In this embodiment, the system 10 generally includes a platform or rig 20 at the water line 12 and a marine riser 30 extending into and through the sea water 14. In this embodiment, the rig 20 generally includes, but is not limited to, a rig floor 22, a derrick 24 extending from the floor 22, and a drill string 26 extending through the floor 22 into and through the marine riser 30 to the sea floor disposed underneath the rig 20. The marine riser 30 extends to a BOP disposed at the sea floor underneath the rig 20 and is configured to provide a conduit for the drill string 26, which extends into a borehole within a subterranean formation disposed below the sea floor. The marine riser 30 has a central or longitudinal axis 35 and generally includes a plurality of riser joints 32, where each riser joint 32 includes a main body 34 (shown encased in low density foam) and a pair of auxiliary lines 36 (extending through the low density foam) that extend the length of each joint 32. Further, disposed along each riser joint 32 is a plurality of riser clamp assemblies 100, which couple the auxiliary lines 36 to the main body 34 of each riser joint 32, as will be described in further detail herein. While clamp assembly 100 is described in this embodiment as a component of drilling and production system 10, in other embodiments clamp assembly 100 may be used in other offshore systems, such as with workover and intervention marine risers. In this embodiment, the clamp assembly 100 may be used to couple a single auxiliary line or umbilical (e.g., electric, hydraulic, or combination) to the intervention or workover marine riser. Further, in this embodiment a work vessel or ship would be used in lieu of a rig, such as rig 20.

Referring to FIGS. 2A-2E, an embodiment of a riser clamp assembly 100 is shown. In this embodiment, riser clamp assembly 100 has a central or longitudinal axis 105 coaxial with central axis 35 and generally includes a clamp body 110, and a plurality of clamp caps 140. In this embodiment clamp body 110 comprises two arcuate sections or halves 110*a* and 110*b*, where each arcuate section 110*a*, and 110*b* extends 180° about the central axis 35 of marine riser 30. Also, in this embodiment clamp body 110 comprises castable polymer; however, in other embodiments clamp body 110 may comprise thermoplastic, nylon, and other nonmetallic materials. While in this embodiment clamp body 110 includes two 180° arcuate sections 110*a* and 110*b*, in other embodiments clamp body 110 may comprise varying numbers of arcuate sections of varying angles. For instance, in another embodiment clamp body 110 may comprise three 120° sections, and in another embodiment clamp body 110 may comprise four 90° arcuate sections. Further, while in this embodiment arcuate sections 110*a* and 110*b* are of equal angle (180°) and circumferential length, in other embodiments the arcuate sections of clamp body 110 may be of unequal angle and circumferential length. For instance, in another embodiment clamp body 110 may comprise a first arcuate section having a first angle of 140°, and a second arcuate section having an angle of 220°.

In this embodiment, riser clamp assembly 100 includes five clamp caps 140, forming a plurality of five apertures 107 (FIG. 2C) each configured to receive and retain an auxiliary line 36 that extends through each aperture 107. Given that the diameter of auxiliary lines 36 is variable, the size of each aperture 107 is variable to approximately match the size of the diameter of its respective auxiliary line 36 to provide an appropriate fit so as to restrict the movement (e.g., rattling, etc.) of the line 36 in its respective aperture 107. However, while the size of each clamp cap 140 is variable to provide for varying sizes of apertures 107, the geometry of each clamp cap 140 is similar. Thus, in other embodiments clamp caps 140 and their respective apertures 107 could be of different sizes to accommodate auxiliary lines 36 of varying sizes. Also, while in this embodiment clamp assembly 100 and clamp body 110 are configured to provide five apertures 107 for clamping five auxiliary lines 36, in other embodiments clamp assembly 100 and clamp body 110 may be configured to provide a different number of apertures 107 for a different number of auxiliary lines 36, depending upon the number of auxiliary lines included in the marine riser.

Figure 2A:
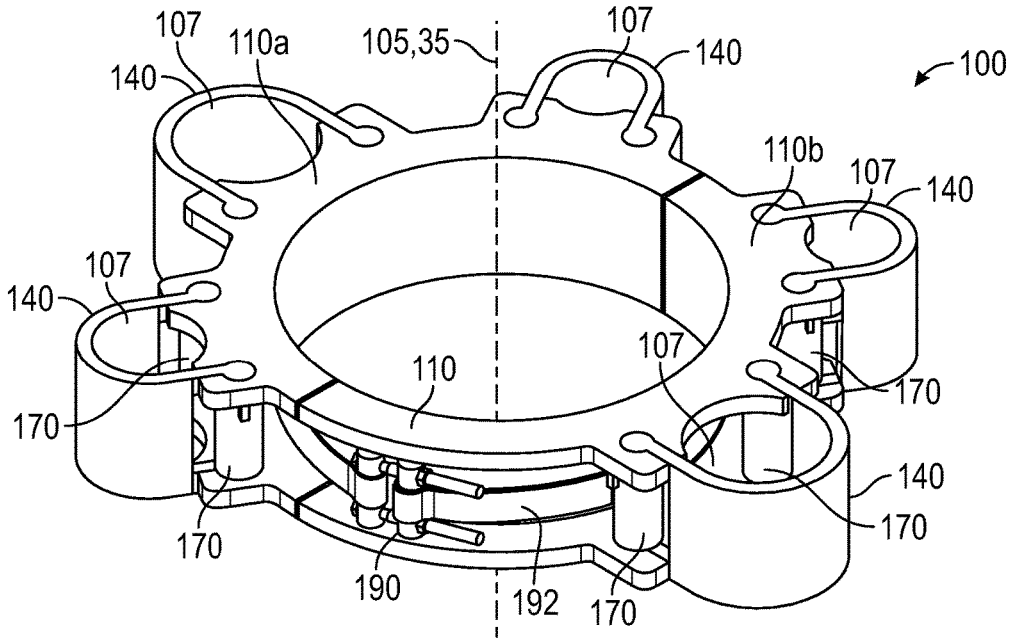
FIG. 2A is a perspective view of an embodiment of a riser clamp assembly in a closed configuration in accordance with principles disclosed herein.
Figure 2B:
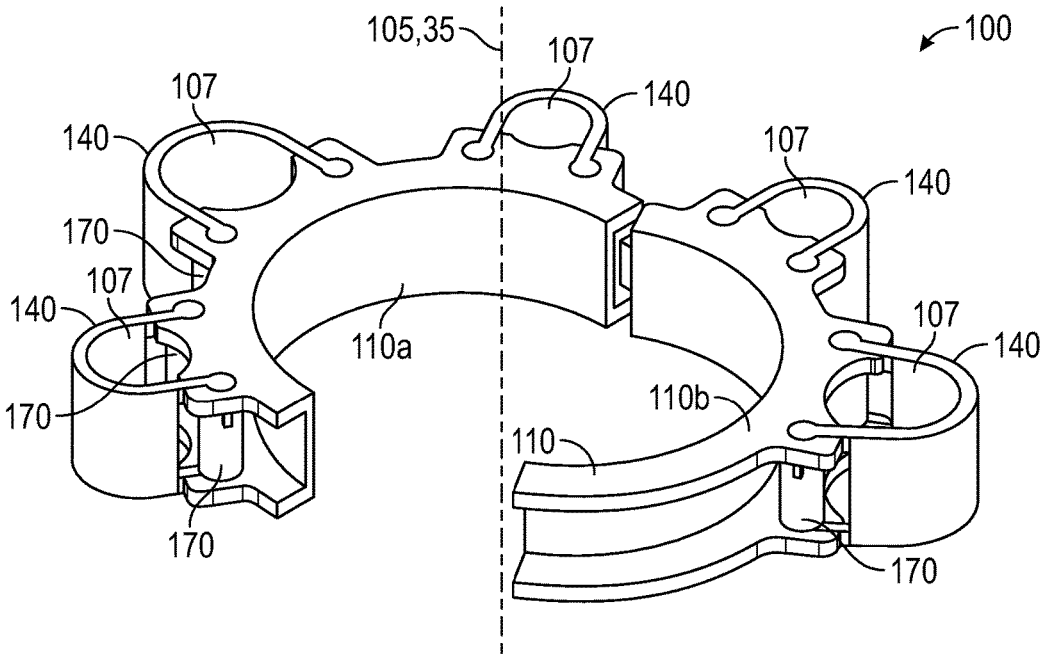
FIG. 2B is a perspective view of the riser clamp assembly of FIG. 2A in an open configuration.
Figure 2C:
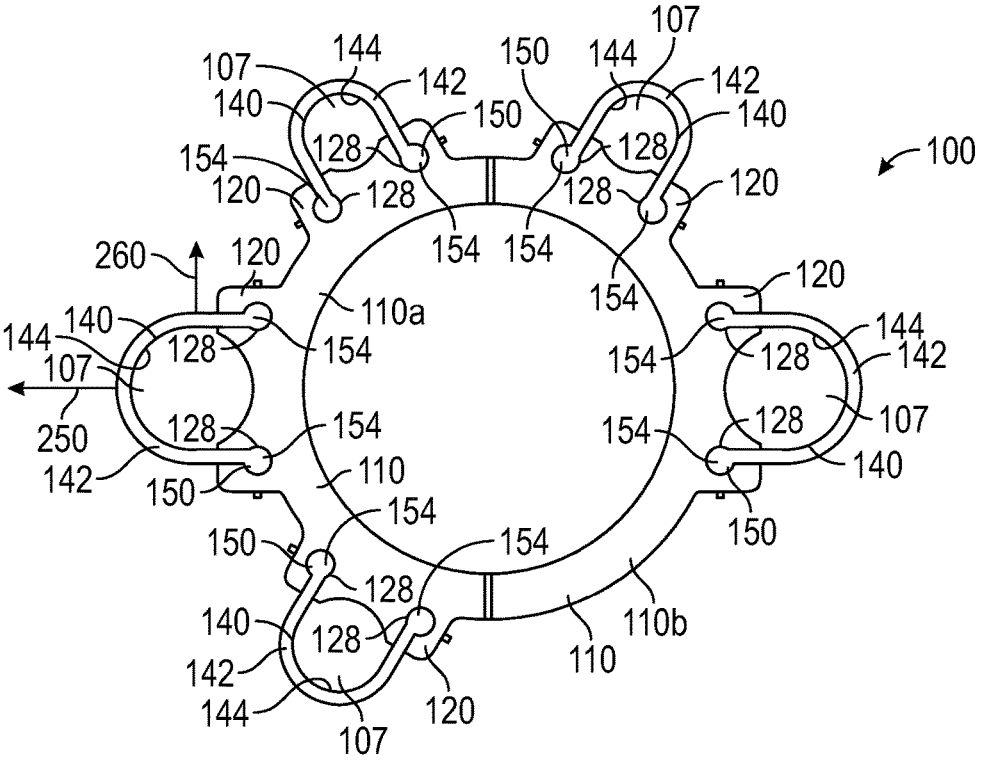
FIG. 2C is a top view of the riser clamp assembly of FIG. 2A.
Figure 2D:
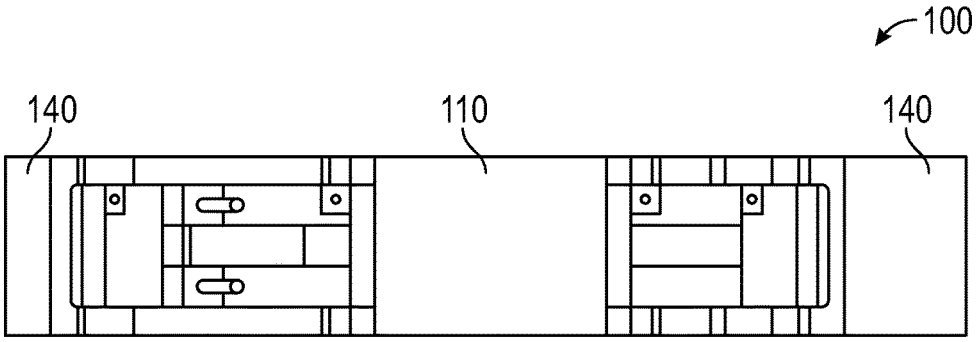
FIG. 2D is a side view of the riser clamp assembly of FIG. 2A.
Figure 2E:
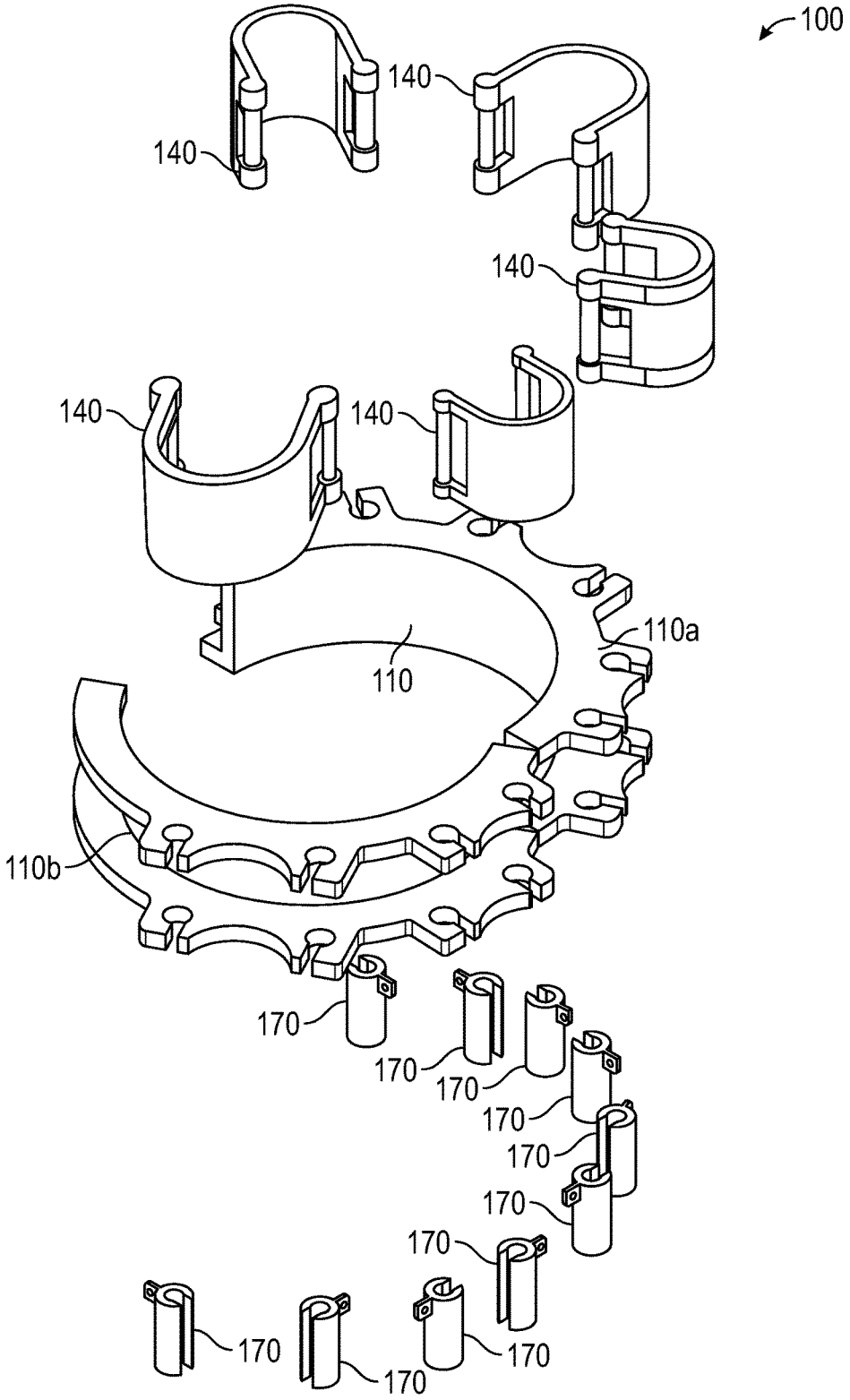
FIG. 2E is an exploded view of the riser clamp assembly of FIG. 2A.
Figure 3A:
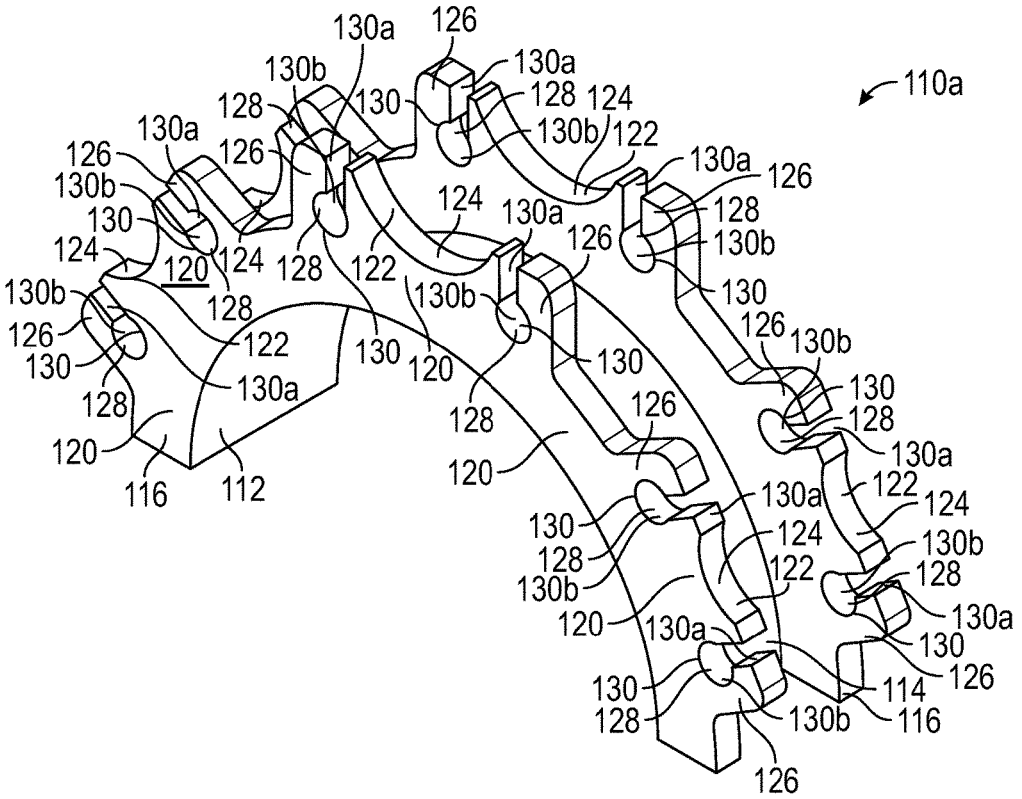
FIG. 3A is a perspective view of an embodiment of an arcuate section of a riser clamp body in accordance with the principles disclosed herein.
Figure 3B:
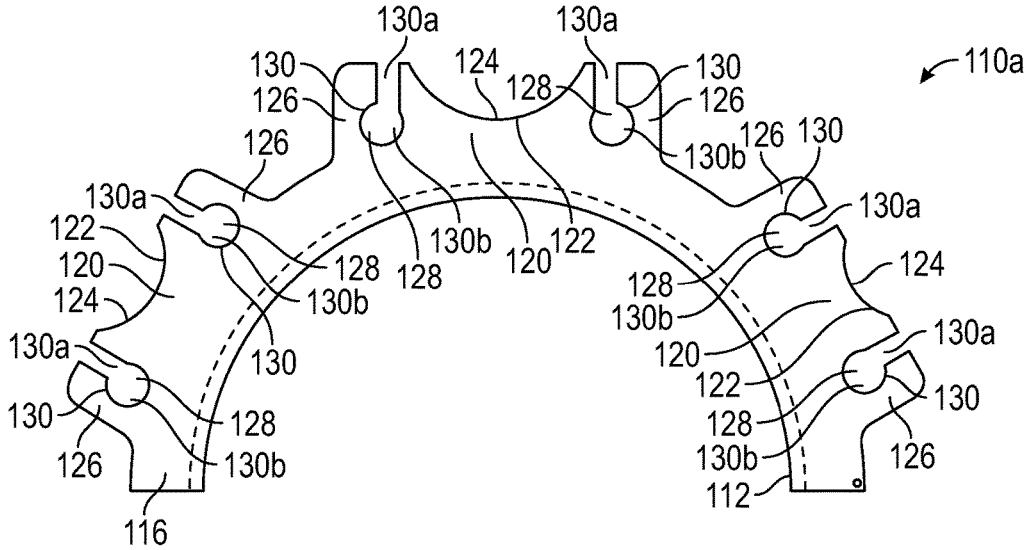
FIG. 3B is a top view of the arcuate section of a riser clamp body shown in FIG. 3A.

Referring now to FIGS. 3A and 3B, arcuate section 110*a* of clamp body 110 is shown. In this embodiment, arcuate section 110*a* generally includes an axially extending inner surface 112, an axially extending outer surface 114, and a pair of arcuate flanges 116 that extend radially from inner surface 112. The radially extending arcuate flanges 116 each comprise a plurality of three cap interfaces 120 that are circumferentially spaced along and radially extending from flanges 116. Each cap interface 120 comprises a saddle 122 and a pair of tabs 126. Cap interfaces 120 are configured to couple with clamp caps 140 such that when the caps 140 have been installed (as shown in FIGS. 2A-2D) radial movement of the caps with respect to central axis 105 of clamp assembly 100 is restricted via physical engagement between clamp caps 140 and cap interfaces 120. Cap interfaces 120 are also configured to allow clamp caps 140 to be installed by inserting the clamp caps axially with respect to central axis 105 into cap interfaces 120. Further, this axial insertion of clamp caps 140 into cap interfaces 120 may be accomplished without the use of tools and with only a single person performing the installation. Thus, the clamp caps may simply slide axially into cap interfaces 120, and once inserted, a radially outward force applied to clamp caps 140 will be resisted by the physical engagement between clamp caps 140 and cap interfaces 120.

Each saddle 122 includes a concave or semicircular outer surface configured to receive and engage a circumferential portion of the outer surface of an auxiliary line 36. The auxiliary line 36 may fit loosely within the saddle 122. The radius of the outer surface of each saddle 122 is equal to or larger than the radius of the respective auxiliary line 36 it is configured to receive and secure. Thus, given that the radius of auxiliary lines 36 (due to their differing diameters) is variable, the radius of the outer surface 124 of each saddle 122 is also variable. Each saddle 122 of cap interfaces 120 is flanked circumferentially by the pair of radially extending tabs 126 that form a pair of sockets 128, defined by an inner surface 130, positioned circumferentially between the saddle 122 and each tab 126. Sockets 128 are configured to axially receive the clamp caps 140, such that they may be installed and prevented from radial movement, as described above. Each socket includes a radially extending rectangular portion 130*a* and a radially inner semicircular portion 130*b*. While in this embodiment, portion 130*b* of sockets 128 is semicircular in cross-section, in other embodiments radially inner portion 130*b* may be of different shapes. For instance, in an alternative embodiment radially inner portion 130*b* may have a square or rectangular cross-sectional shape. In another embodiment, radially inner portion 130*b* may have a hexagonal or star-shaped cross-sectional shape.

Referring now to FIGS. 4A-4D, an embodiment of a clamp cap 140 is shown. In this embodiment, clamp cap comprises a polyurethane material, but in other embodiments clamp cap 140 may comprise other materials. Clamp cap 140 has a central or longitudinal axis that is parallel with and radially offset from central axis 105 of clamp assembly 100 (when in the assembled configuration as shown in FIGS. 2A-2D) and generally includes a curved or U-shaped body 142 and a clamp body interface 150. Cap body 142 includes a curved inner surface 144 that is configured to receive and constrain a circumferential portion of the outer surface of an auxiliary line 36. Similar to the saddles 122 of cap interfaces 120, the radius of the outer surface of inner surface 144 of cap body 142 is equal to or larger than the radius of the respective auxiliary line 36 it is configured to receive and secure. Thus, given that the radius of auxiliary lines 36 (due to their differing diameters) is variable, the radius of the inner surface 144 of each cap body 142 is also variable depending upon the size of the clamp cap 140.

Clamp interface 150 is configured to be axially (i.e., in a direction parallel with axis axis 105 of clamp assembly 100) inserted into sockets 128 of the clamp cap interfaces 120 of clamp body 110, such that the clamp cap 140 may be installed and prevented from radial movement, as described above. The clamp body interface 150 generally includes radially inward extending (relative to axis 105 when in the assembled configuration) upper and lower legs 152 and an axially extending generally cylindrical tab 154 that is disposed at the radially inward ends of legs 152. While in this embodiment, cylindrical tabs 154 are circular in cross-section (shown in FIGS. 4C and 4D), in other embodiments tabs 154 may be of different shapes. For instance, in an alternative embodiment tabs 154 may have a square or rectangular cross-sectional shape. In another embodiment, tabs 154 may have a hexagonal or star-shaped cross-sectional shape.

Figure 4A:
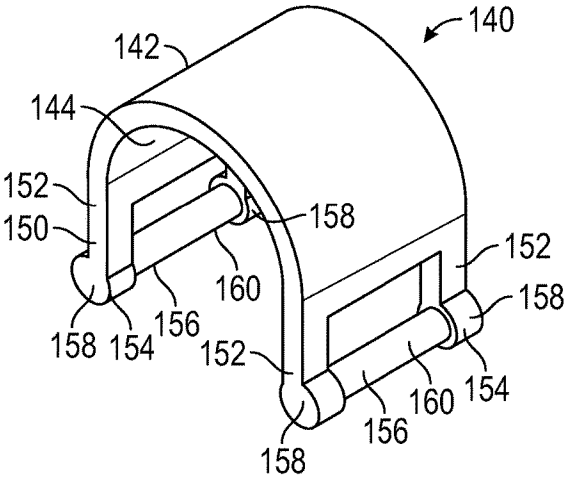
FIG. 4A is a perspective view of an embodiment of a riser clamp cap in accordance with principles disclosed herein.
Figure 4B:
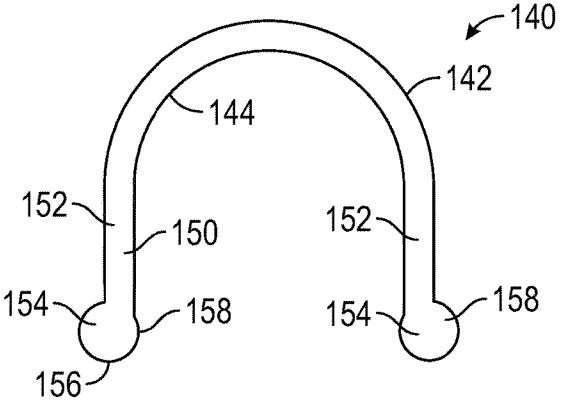
FIG. 4B is a top view of the riser clamp cap of FIG. 4A.
Figure 4C:
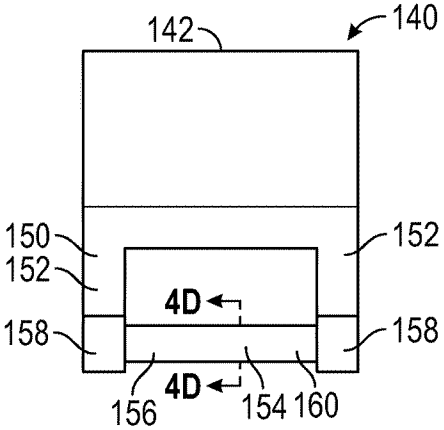
FIG. 4C is a side view of the riser clamp cap of FIG. 4A.
Figure 4D:
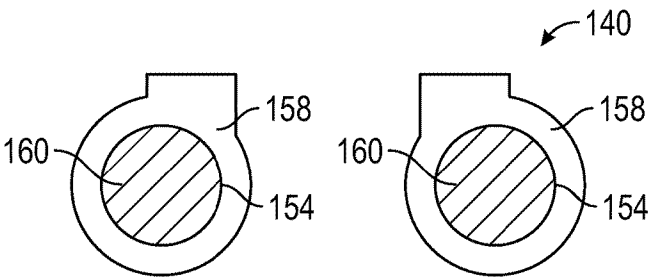
FIG. 4D is a cross-sectional view along section C-C of FIG. 4C, illustrating the riser clamp cap of FIG. 4A.

As shown in FIGS. 4A, 4C, and 4D, cylindrical tabs 154 have an outer generally cylindrical surface 156 and include a pair of large diameter portions 158 disposed at the end of each leg 152 and a small diameter portion 160 that extends axially between large diameter portions 158. Large diameter portions 158 of cylindrical tabs 154 are configured to be closely matched in diameter to allow for ease of installation within the semicircular portion 130*b* of socket 128, preventing chatter or movement between clamp cap 140 and clamp body 110 once clamp body interface 150 of clamp cap 140 has been inserted into and engages clamp cap interface 120 of clamp body 110. Thus, the diameter of large diameter portions 158 is slightly smaller than the diameter of the semicircular portions 130*b* of sockets 128. Similarly, legs 152 of clamp body interface 150 of clamp caps 140 are configured to fit within rectangular portions 130*a* of sockets 128, and thus, the width of legs 152 is slightly smaller than the width of rectangular portions 130*a* of the sockets 128 of clamp cap interface 120.

When in the assembled configuration (shown in FIGS. 2A-2D), when a perpendicular load 250 (FIG. 2C) is applied to a clamp cap 240, such as a load applied by an auxiliary line moving perpendicularly with respect to axis 105 of clamp assembly 100, the load 250 is transferred along a load transfer path comprising a first transfer of load 250 from the auxiliary line 36 to cap body 142 via inner surface 144, where load 250 is then distributed to the legs 152 (FIG. 2E) of clamp body interface 150, and from the legs 152 to the large diameter portions 158 of cylindrical tabs 154. At this point, the perpendicular load 250 is transferred along the transfer path between the clamp body interface 150 of clamp cap 140 and the clamp cap interface 120 of arcuate section 110*a* of clamp body 110 through physical engagement between the outer surface 156 of the large diameter portion 158 of cylindrical tabs 154 and inner surface 130 of radially extending tabs 126 that defines semicircular portion 130*b* of sockets 128. Finally, the load 250 is then transferred from arcuate section 110*a* to clamp strap 190, from strap 190 to opposing arcuate section 110*b* of clamp body 110, and from arcuate section 110*b* to the marine riser (e.g., marine riser 30). Thus, through engagement between clamp body interface 150 of clamp cap 140 and the clamp cap interface 120 of clamp body 110, perpendicular load 250 is transferred via the load transfer path from clamp cap 140 to clamp body 110.

Similarly, when a rotational or torsional load 260 is applied to clamp cap 140, such as via a force applied by the auxiliary line 36 tangent to central axis 105 of clamp assembly 100, the load is transferred between clamp cap 140 and clamp body 110 via the engagement between clamp body interface 150 of cap 140 and clamp cap interface 120 of body 110. When resisting rotational load 260, the engagement between interfaces 140 and 120 also includes physical engagement between the outer surface of legs 152 and inner surface 130 of radially extending tabs 126 that defines rectangular portion 130*a* of sockets 130.

In an embodiment, clamp assembly 100 may also include a plurality of clamp clips 170. Referring now to FIGS. 5A-5D, an embodiment of a clamp clip 170 is shown. In some embodiments, clamp clips 170 are configured to retain clamp caps 140 in axial position when clamp assembly 100 is in the assembled configuration as shown in FIGS. 2A-2D. Given that the clamp body interface 150 of clamp cap 140 is configured to be axially inserted into the clamp body interface 120 of clamp body 110, the interaction between interfaces 150 and 120 may not fully restrict relative axial movement between clamp cap 140 and clamp body 110. Thus, once the interface 150 of cap 140 is fully inserted into interface 120 of body 110 the clamp clip 170 is coupled to cap 140 to restrain 140 from moving axially relative clamp body 110, thus securing clamp cap 140 relative to clamp body 110.

Figure 5B:
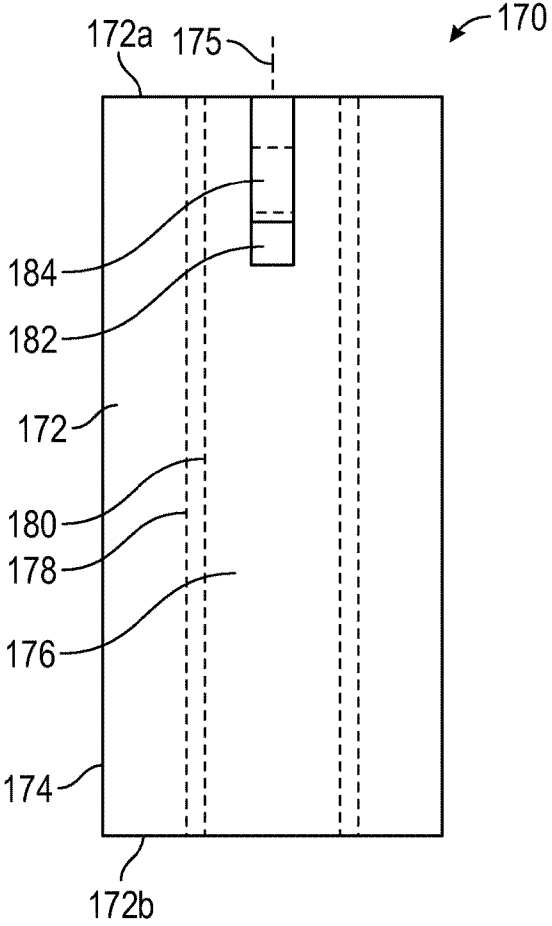
FIG. 5B is a front view of the riser clamp clip of FIG. 5A.
Figure 5A:
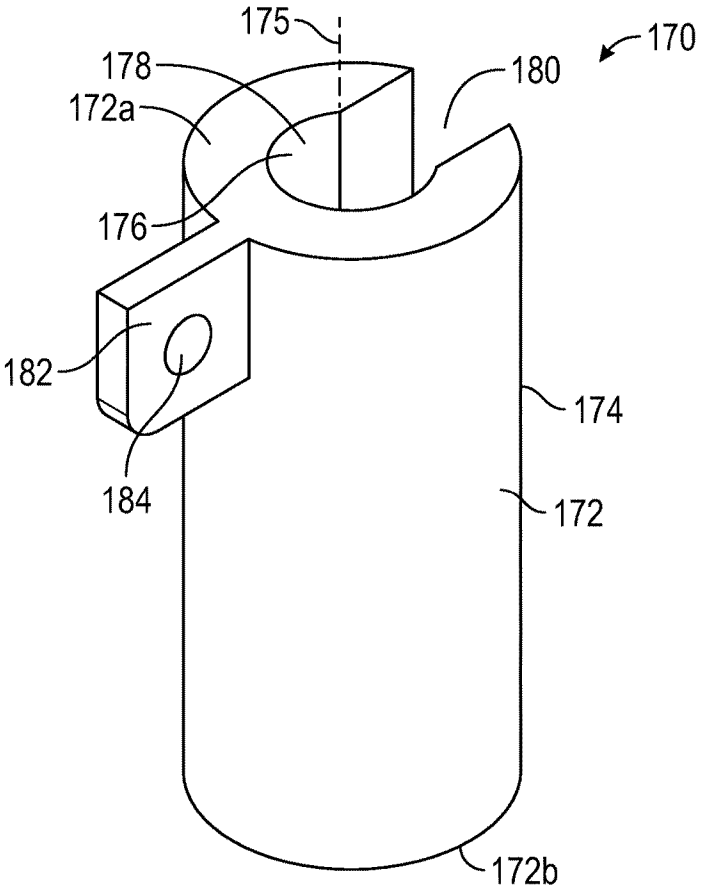
FIG. 5A is a perspective view of an embodiment of a riser clamp clip in accordance with principles disclosed herein.
Figure 5D:
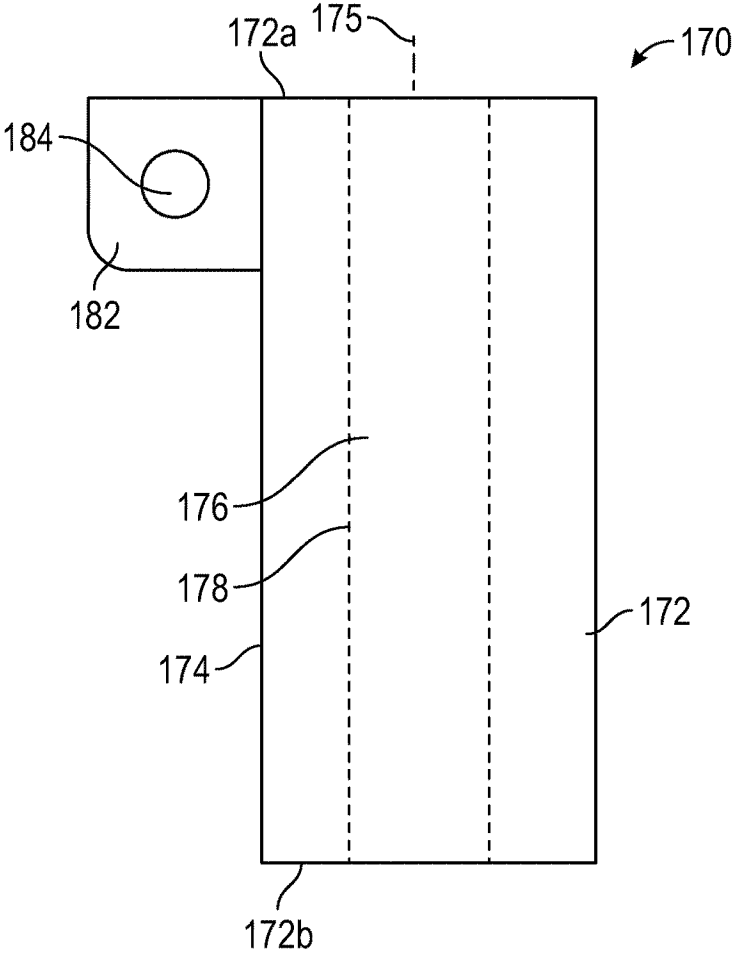
FIG. 5D is a side view of the riser clamp clip of FIG. 5A.
Figure 5C:
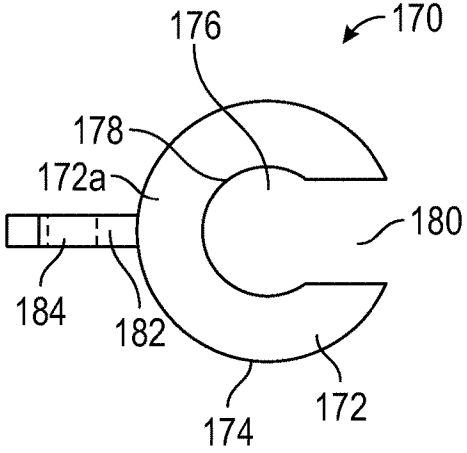
FIG. 5C is a top view of the riser clamp clip of FIG. 5A.

In this embodiment, clip 170 comprises a polyurethane material, but in other embodiments comprises other nonmetallic and compliant materials such as nylon, Teflon, and the like. Clip 170 has a central axis 175 parallel with and radially offset from central axis 105 of clamp body 100 when in the assembled configuration and includes a generally cylindrical body 172 having an outer surface 174, a cylindrical central bore 176 defined by an inner surface 178 extending between an upper end 172*a* and a lower end 172*b* of the body 172 along central axis 175, and an offset rectangular slot 180. The rectangular slot 180 extends axially between the upper and lower ends of body 172 and radially between central bore 176 and the outer surface 174. The width of rectangular slot 180 is less than the diameter of central bore 176, as shown in FIGS. 5A and 5C. Cylindrical body 172 of clip 170 also includes a tab 182 disposed at upper end 172*a* and extending radially outward from outer surface 174. Tab 182 includes a centrally disposed aperture 184 configured to receive an elongate prying tool, such as a boot-jack or similar appliance, for assisting in coupling and decoupling the tab from clamp cap 140.

To couple the clamp cap 140 to the clamp clip 170, the clip 170 is configured to be inserted over the small diameter portion 160 of each cylindrical tab 154 of clamp cap 140. Specifically, the clamp clip 170 is configured such that the small diameter portion 160 of tab 154 may be inserted through rectangular slot 180 and inserted into the central bore 176 of clip 170. Central bore 176 is configured such that small diameter portion 160 of tab 154 has an interference fit with central bore 176. Given that the width of rectangular slot 180 is smaller than the diameter of central bore 176, and is thus smaller than the diameter of small diameter portion 160 of tab 154, to insert the small diameter portion 160 into central bore 176 the rectangular slot 180 must be forcibly enlarged.

The forcible insertion of portion 160 of cylindrical tab 154 into central bore 176 may be accomplished by administering a sufficiently large force against the body 172 of clip 170 to force or urge small diameter portion 160 of tab 154 through the rectangular slot 180 by flexing the complaint body 172 of clip 170. Thus, once portion 160 of tab 154 has been successfully forced into central bore 176, the body 172 will return to its original shape and clamp clip 170 will be coupled or secured to the cylindrical tab 154 of clamp cap 140, as shown in the assembled configuration of clamp assembly 100 in FIGS. 2A-2D. Similarly, the clamp clip 170 may be decoupled or removed from cylindrical tab 154 of cap 140, without damaging either clip 170 or cap 140, by applying a pulling force on tab 182, urging portion 160 of cylindrical tab 154 back through the rectangular slot 180.

Figure 6A:
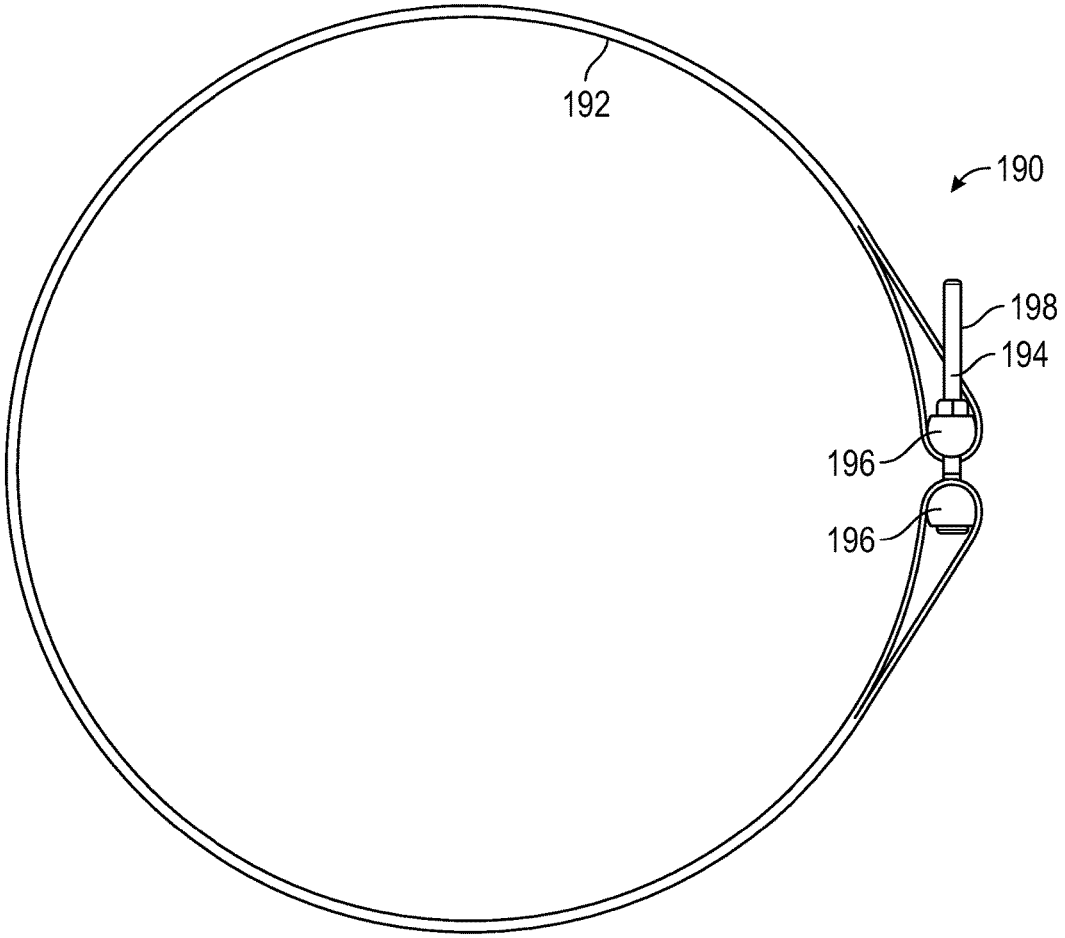
FIG. 6A is a top view of an embodiment of a riser clamp strap in accordance with principles disclosed herein.
Figure 6B:
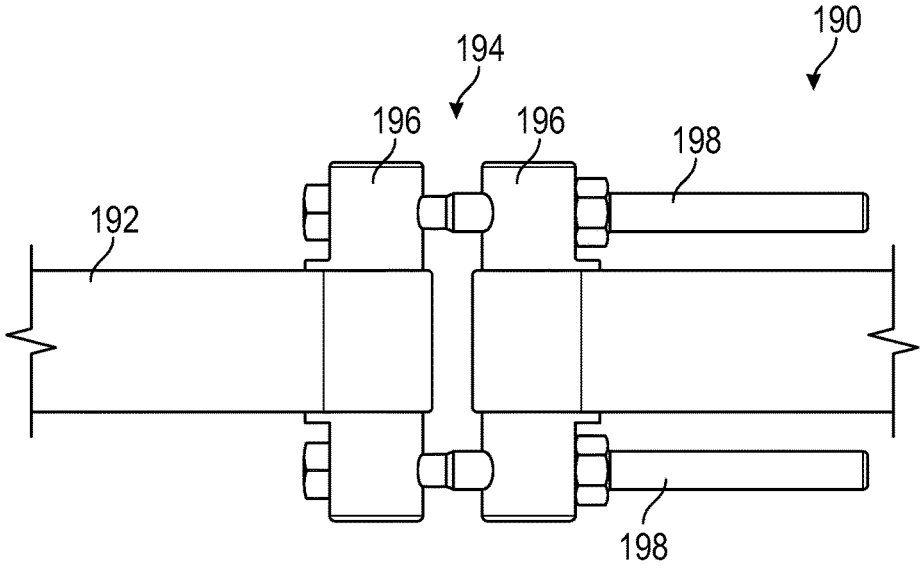
FIG. 6B is a partial front view of the riser clamp strap of FIG. 6A.

In an embodiment, clamp assembly 100 may further include a clamp strap 190. Referring now to FIGS. 2C, 6A and 6B, an embodiment of clamp strap 190 is shown. Clamp strap 190 is configured to secure arcuate sections 110*a* and 110*b* of clamp body 110 together to form the assembled configuration shown in FIGS. 2A-2D. Further, clamp strap 190 is also configured to transfer loads applied to clamp body 110, such as loads 250 and 260 discussed above, to the marine riser 30 (FIG. 1). For instance, when perpendicular load 250 is applied to clamp cap 140, the clamp strap 190 prevents arcuate sections 110*a* and 110*b* from losing physical contact with the marine riser 30. Moreover, clamp strap 190 is configured to provide a clamping force to marine riser 30, securing clamp assembly 100 to marine riser 30 both axially, radially, and rotationally in order to resist perpendicular loads (e.g., perpendicular load 250) and rotational loads (e.g., rotational load 260) applied to clamp assembly 100 through auxiliary lines 36.

Clamp strap 190 generally includes a strap 192 and a drawbar assembly 194. In this embodiment, strap 192 comprises aramid fiber, such as the aramid fiber straps provided by Roblon A/S, Nordhavnsvej 1 PO Box 120, 9900 Frederikshavn, Denmark. However, in other embodiments strap 192 may comprise other high strength and resilient materials. In certain embodiments, drawbar assembly 194 may comprise the only metallic components of clamp assembly 100 and is configured to couple the ends of strap 192 together such that clamp strap 190 may provide a clamping force to clamp body 110. Drawbar assembly 194 generally includes a pair of cylindrical members 196, one disposed at each end of strap 192, and a pair of bolts 198, with each bolt extending through members 196 on each side of strap 192 and coupling members 196 together.

Figure 7:
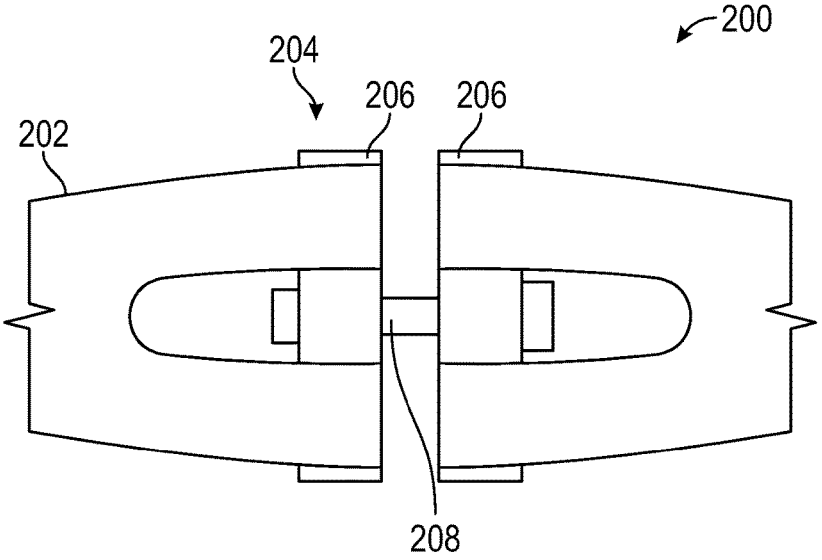
FIG. 7 is a partial front view of another embodiment of a riser clamp strap in accordance with principles disclosed herein.

Referring now to FIG. 7, another embodiment of a clamp strap 200 is shown. In this embodiment, clamp strap 200 generally includes a strap 202 and a drawbar assembly 204. Strap 202 is similar to strap 192 of clamp strap 190 and likewise comprises aramid fiber, such as the aramid fiber straps sold by Roblon A/S, as mentioned above. However, strap 202 is pronged at each end to work in conjunction with drawbar assembly 204. Drawbar assembly generally includes a pair of cylindrical members 206, one disposed at each end of strap 202, and a single bolt 208 extending through members 206 along a central axis of strap 202 and coupling members 206 together. Thus, drawbar assembly 204 is similar to drawbar assembly 194, but instead of including a pair of bolts 198 disposed on each side of strap and near the axial ends of members 196, assembly 204 includes a single bolt 208 extending along a central axis of strap 202 and approximately equidistant from the axial ends of members 206.

Having described the structure of the clamp assembly 100, a method of assembling clamp assembly 100 will now be discussed. First, each arcuate section 110*a* and 110*b* is disposed about the main body 34 of a riser joint 32 and either of clamp straps 190 or 200 may be coupled to the positioned clamp body 110 to couple together arcuate sections 110*a*, 110*b*, and apply a clamping force to riser joint 32. For instance, to secure clamp strap 200 about clamp body 110 a single socket wrench may be used to apply torque to the single bolt 208 to decrease the overall diameter of clamp strap 200 and increase the clamping force applied to the clamp body 110, and in turn, the riser joint 32.

Next, a first auxiliary line 36 is disposed against a saddle 122 of a clamp cap interface 120 of clamp body 110. Once the auxiliary line 36 has been positioned such that the outer surface of line 36 engages the curved surface of saddle 122, the respective clamp cap 140 corresponding to that particular clamp interface 120 may be coupled to the clamp body 110. As described more thoroughly above, the clamp interface 150 of the respective clamp cap 140 is inserted axially into the corresponding clamp interface 120 of clamp body 110, and once interfaces 120 and 150 have successfully engaged to restrict radial and rotational movement between the clamp cap 140 and clamp body 110, a clamp clip 170 is coupled to each cylindrical tab 154 of the clamp cap 140 to lock cap 140 into position with respect to clamp body 110 and to successfully clamp the first auxiliary line 36 to the clamp assembly 100. This process is repeated until each auxiliary line 36 has been successfully installed in its respective aperture 107, thus completing the installation and assembly of clamp assembly 100. In order to uninstall the clamp assembly 100 and decouple the auxiliary lines 36 from the marine riser 30, the above process may be repeated in reverse order, beginning with the removal of each auxiliary line 36 by first removing the clamp clips 170 coupled to the cylindrical tabs 154 of the first clamp cap 140, thus allowing the removal of the first auxiliary line 36. Once the auxiliary lines 36 have been removed via the removal of the clamp clips 170 and clamp caps 140, the clamp body 110 may be removed from the riser joint 32 by untorquing the bolt 208 of drawbar assembly 204 using a single socket wrench and removing clamp strap 200 from clamp body 110.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A clamp assembly for coupling an auxiliary line to a marine riser, comprising:

a clamp body having a central axis and an interface radially spaced from the central axis; and a clamp cap comprising a cap body and an interface that includes an elongate tab and a leg extending between the tab and the cap body, wherein the tab and the leg of the interface are configured to be inserted along an axis parallel with the central axis of the clamp body into the interface of the clamp body;

wherein the clamp body is configured to clamp to the marine riser;

wherein the clamp body and clamp cap are configured to retain the auxiliary line in an aperture formed between the interface of the clamp body and the interface of the clamp cap.

2. The clamp assembly of claim 1, further comprising a clamp strap configured to couple the clamp body to the marine riser.

3. The clamp assembly of claim 1, wherein the clamp body comprises a nonmetallic material.

4. The clamp assembly of claim 1, wherein the clamp cap comprises a nonmetallic material.

5. The clamp assembly of claim 1, further comprising a clamp clip configured to secure the clamp cap to the clamp body.

6. The clamp assembly of claim 5, wherein the clamp clip comprises a nonmetallic material.

7. The clamp assembly of claim 1, wherein a load applied to the clamp cap is transferred from the clamp cap to the clamp body through physical contact between the clamp cap and the clamp body.

8. The clamp assembly of claim 7, wherein the load is transferred from the clamp body to the marine riser through physical contact between the clamp body and a clamp strap coupled to the clamp body.

9. The clamp assembly of claim 1, wherein the clamp cap interface comprises a cylindrical tab and the clamp body interface comprises a socket, and wherein the cylindrical tab is configured to be inserted axially into the socket to form the aperture.

10. The clamp assembly of claim 9, further comprising a clamp clip configured to secure the clamp cap to the clamp body, wherein the clamp clip comprises a cylindrical body having an axially extending central bore, and wherein the tab of the clamp cap is configured to be inserted into the bore of the clamp clip to retain the clamp cap to the clamp body.

11. The clamp assembly of claim 1, wherein the interface of the clamp body and the interface of the clamp cap do not comprise metallic components.

12. A clamp assembly for coupling an auxiliary line to a marine riser, comprising:

a nonmetallic clamp body having a central axis and an interface radially spaced from the central axis, and wherein the clamp body comprises a first arcuate section and a second arcuate section;

a nonmetallic clamp cap comprising a cap body and an interface that includes an elongate tab and a leg extending between the tab and the cap body, wherein the tab and the leg of the interface are configured to be inserted along an axis parallel with the central axis of the clamp body into the interface of the clamp body; and a clamp strap configured to couple the first arcuate section of the clamp body to the second arcuate section of the clamp body and provide a clamping force to the marine riser;

a clamp clip configured to secure the clamp cap to the clamp body by coupling to an outer surface of the clamp cap;

wherein the clamp body and clamp cap are configured to retain the auxiliary line in an aperture formed between the interface of the clamp body and the interface of the clamp cap.

13. The clamp assembly of claim 12, wherein a load applied to the clamp cap is transferred from the clamp cap to the clamp body through physical contact between the clamp cap and the clamp body.

14. The clamp assembly of claim 13, wherein the load is transferred from the clamp body to the marine riser through physical contact between the clamp body and the clamp strap.

15. The clamp assembly of claim 12, wherein the clamp cap interface comprises a cylindrical tab and the clamp body interface comprises a socket, and wherein the cylindrical tab is configured to be inserted axially into the socket to form the aperture.

16. The clamp assembly of claim 15, wherein the clamp clip comprises a cylindrical body having an axially extending central bore, and wherein the tab of the clamp cap is configured to be inserted into the bore of the clamp clip to retain the clamp cap to the clamp body.

17. The clamp assembly of claim 12, wherein:

the clamp clip comprises a central bore and a slot extending between the central bore and an outer surface of the clamp clip; and the central bore of the clamp clip is configured to receive the tab of the clamp cap.

18. A method for clamping an auxiliary line to a marine riser, comprising:

strapping a first arcuate section of a clamp body to a second arcuate section of a clamp body to provide a clamping force to the marine riser;

disposing the auxiliary line adjacent an interface of the clamp body; and inserting an elongate tab and a leg of an interface of a clamp cap along an axis parallel with a central axis of the clamp body into the interface of the clamp body to couple the auxiliary line to the clamp body, wherein the leg of the interface of the clamp cap extends between the tab and a cap body of the clamp cap.

19. The method of claim 18, further comprising retaining the clamp cap to the clamp body by coupling a clamp clip to the clamp cap.

20. The method of claim 18, further comprising transferring a load applied to the clamp cap to the marine riser through physical engagement between the clamp cap and clamp body.

* * * * *